US009098013B2

(12) United States Patent
Yasunaga et al.

(10) Patent No.: US 9,098,013 B2
(45) Date of Patent: Aug. 4, 2015

(54) DEVELOPING ROLLER, DEVELOPING DEVICE, PROCESS CARTRIDGE, AND IMAGE FORMING APPARATUS

(71) Applicants: Hideaki Yasunaga, Osaka (JP); Keiichiro Juri, Hyogo (JP); Yuta Takeuchi, Hyogo (JP); Tsuyoshi Nozaki, Osaka (JP); Yoshimichi Ishikawa, Hyogo (JP); Tomoharu Miki, Osaka (JP)

(72) Inventors: Hideaki Yasunaga, Osaka (JP); Keiichiro Juri, Hyogo (JP); Yuta Takeuchi, Hyogo (JP); Tsuyoshi Nozaki, Osaka (JP); Yoshimichi Ishikawa, Hyogo (JP); Tomoharu Miki, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/259,576

(22) Filed: Apr. 23, 2014

(65) Prior Publication Data

US 2014/0321888 A1 Oct. 30, 2014

(30) Foreign Application Priority Data

Apr. 26, 2013 (JP) ..... 2013-094515
Jul. 12, 2013 (JP) ..... 2013-146011

(51) Int. Cl.
*G03G 15/08* (2006.01)
*G03G 21/18* (2006.01)

(52) U.S. Cl.
CPC ..... *G03G 15/0818* (2013.01); *G03G 15/0865* (2013.01); *G03G 21/18* (2013.01)

(58) Field of Classification Search
USPC ..... 399/279, 286
See application file for complete search history.

(56) References Cited

U.S. PATENT DOCUMENTS

| | | | | |
|---|---|---|---|---|
| 6,253,053 | B1 * | 6/2001 | Litman et al. | 399/286 |
| 7,720,428 | B2 | 5/2010 | Hagi et al. | |
| 7,925,192 | B2 * | 4/2011 | Kojima et al. | 399/276 |
| 8,110,330 | B2 | 2/2012 | Ishikawa et al. | |
| 8,338,066 | B2 | 12/2012 | Nozaki et al. | |
| 8,526,864 | B2 | 9/2013 | Nakagawa et al. | |
| 2005/0069351 | A1 * | 3/2005 | Matsuo et al. | 399/286 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2007/0059625 | A1 | 3/2007 | Yamamoto et al. | |
| 2007/0122729 | A1 | 5/2007 | Katoh et al. | |
| 2007/0148568 | A1 | 6/2007 | Kadota et al. | |
| 2007/0166635 | A1 | 7/2007 | Yamamoto et al. | |
| 2007/0190442 | A1 | 8/2007 | Nakamura et al. | |
| 2007/0190443 | A1 | 8/2007 | Hagi et al. | |
| 2007/0207399 | A1 | 9/2007 | Kadota et al. | |

(Continued)

FOREIGN PATENT DOCUMENTS

| | | |
|---|---|---|
| JP | 06-175476 | 6/1994 |
| JP | 2004-347664 | 12/2004 |

(Continued)

*Primary Examiner* — Clayton E Laballe
*Assistant Examiner* — Warren K Fenwick
(74) *Attorney, Agent, or Firm* — Cooper & Dunham LLP

(57) ABSTRACT

A developing roller, including: a shaft containing a metal; an elastic layer on a circumference of the shaft; and a surface layer on a circumferential surface of the elastic layer, wherein the surface layer contains: a polyurethane which is a reaction product between a fluoroethylene vinyl ether copolymer and an isocyanurate form of an isocyanate; and particles having an average primary particle diameter of 5 nm to 30 nm, and wherein the polyurethane has a peak intensity ratio of a NCO group to a hydroxyl group of 5.6 to 8.8 in an infrared absorption spectrum obtained by an attenuated total reflection method.

10 Claims, 5 Drawing Sheets

(56) References Cited

U.S. PATENT DOCUMENTS

| | | | |
|---|---|---|---|
| 2007/0212630 | A1 | 9/2007 | Yasunaga et al. |
| 2007/0217842 | A1 | 9/2007 | Kato et al. |
| 2007/0218384 | A1 | 9/2007 | Matsumoto et al. |
| 2007/0218388 | A1 | 9/2007 | Kurose et al. |
| 2007/0218390 | A1 | 9/2007 | Nozaki et al. |
| 2007/0218393 | A1 | 9/2007 | Nozaki et al. |
| 2007/0238042 | A1 | 10/2007 | Yasunaga et al. |
| 2008/0032223 | A1 | 2/2008 | Yamamoto et al. |
| 2008/0038656 | A1 | 2/2008 | Yasunaga et al. |
| 2008/0063957 | A1 | 3/2008 | Murakami et al. |
| 2008/0069598 | A1 | 3/2008 | Murakami et al. |
| 2008/0069605 | A1 | 3/2008 | Fuwa et al. |
| 2008/0069608 | A1 | 3/2008 | Katoh et al. |
| 2008/0069617 | A1 | 3/2008 | Matsumoto et al. |
| 2008/0070149 | A1 | 3/2008 | Kato et al. |
| 2008/0076054 | A1 | 3/2008 | Nozaki et al. |
| 2008/0081273 | A1 | 4/2008 | Murakami et al. |
| 2008/0096119 | A1 | 4/2008 | Yamamoto et al. |
| 2008/0124635 | A1 | 5/2008 | Nakamura et al. |
| 2008/0153018 | A1 | 6/2008 | Mikuriya et al. |
| 2008/0159777 | A1 | 7/2008 | Fuwa et al. |
| 2008/0175630 | A1 | 7/2008 | Yasunaga et al. |
| 2008/0176159 | A1 | 7/2008 | Matsumoto et al. |
| 2008/0220357 | A1 | 9/2008 | Nozaki et al. |
| 2008/0226356 | A1 | 9/2008 | Yasunaga et al. |
| 2008/0227001 | A1 | 9/2008 | Kadota et al. |
| 2008/0227009 | A1 | 9/2008 | Fuwa et al. |
| 2008/0227013 | A1 | 9/2008 | Kadota et al. |
| 2008/0227016 | A1 | 9/2008 | Nozaki et al. |
| 2008/0232857 | A1 | 9/2008 | Matsumoto et al. |
| 2008/0233497 | A1 | 9/2008 | Yamamoto et al. |
| 2008/0233506 | A1 | 9/2008 | Hagi et al. |
| 2008/0233510 | A1 | 9/2008 | Nozaki et al. |
| 2008/0233511 | A1 | 9/2008 | Ishikawa et al. |
| 2008/0279591 | A1 | 11/2008 | Yasunaga et al. |
| 2008/0304875 | A1 | 12/2008 | Katoh et al. |
| 2009/0017391 | A1 | 1/2009 | Yamamoto et al. |
| 2009/0041511 | A1 | 2/2009 | Fuwa et al. |
| 2009/0052952 | A1 | 2/2009 | Katoh et al. |
| 2009/0117481 | A1 | 5/2009 | Yasunaga et al. |
| 2009/0169270 | A1 | 7/2009 | Fuwa et al. |
| 2009/0186289 | A1 | 7/2009 | Nakamura et al. |
| 2009/0186291 | A1 | 7/2009 | Mikuriya et al. |
| 2009/0220879 | A1 | 9/2009 | Matsumoto et al. |
| 2009/0232542 | A1 | 9/2009 | Yamamoto et al. |
| 2009/0233199 | A1 | 9/2009 | Nozaki et al. |
| 2009/0257792 | A1 | 10/2009 | Nakamura et al. |
| 2009/0297975 | A1 | 12/2009 | Ishikawa et al. |
| 2009/0297976 | A1 | 12/2009 | Yamamoto et al. |
| 2010/0009282 | A1 | 1/2010 | Katoh et al. |
| 2010/0150609 | A1 | 6/2010 | Nozaki et al. |
| 2010/0167196 | A1 | 7/2010 | Hagi et al. |
| 2010/0239974 | A1 | 9/2010 | Nozaki et al. |
| 2011/0045401 | A1 | 2/2011 | Murakami et al. |
| 2011/0053063 | A1 | 3/2011 | Kadota et al. |
| 2011/0053071 | A1 | 3/2011 | Miki et al. |
| 2011/0053077 | A1 | 3/2011 | Mikuriya et al. |
| 2011/0164901 | A1 | 7/2011 | Yamamoto et al. |
| 2011/0217644 | A1 | 9/2011 | Yamamoto et al. |
| 2011/0250533 | A1 | 10/2011 | Kadota et al. |
| 2011/0274471 | A1* | 11/2011 | Ohsawa et al. ..... 399/276 |
| 2011/0287356 | A1 | 11/2011 | Fukao et al. |
| 2012/0207508 | A1* | 8/2012 | Nishiyama et al. ..... 399/99 |
| 2012/0219321 | A1 | 8/2012 | Fukao et al. |
| 2012/0237253 | A1 | 9/2012 | Fukao et al. |
| 2012/0237267 | A1 | 9/2012 | Fukao et al. |
| 2012/0237270 | A1 | 9/2012 | Juri et al. |
| 2012/0251938 | A1 | 10/2012 | Yamamoto et al. |
| 2012/0264048 | A1 | 10/2012 | Ishikawa et al. |
| 2013/0029260 | A1 | 1/2013 | Nozaki et al. |
| 2013/0058685 | A1 | 3/2013 | Juri et al. |
| 2013/0344427 | A1 | 12/2013 | Kadota et al. |
| 2014/0038095 | A1 | 2/2014 | Ishikawa et al. |
| 2014/0050504 | A1 | 2/2014 | Fukao et al. |

FOREIGN PATENT DOCUMENTS

| | | |
|---|---|---|
| JP | 2005-121932 | 5/2005 |
| JP | 2007-057559 | 3/2007 |
| JP | 2011-215467 | 10/2011 |
| JP | 2012-212117 | 11/2012 |
| JP | 2013-015715 | 1/2013 |

* cited by examiner

DEVELOPING ROLLER, DEVELOPING DEVICE, PROCESS CARTRIDGE, AND IMAGE FORMING APPARATUS

BACKGROUND OF THE INVENTION

1. Field of the Invention

The present invention relates to a developing roller, a developing device, a process cartridge, and an image forming apparatus.

2. Description of the Related Art

One-component development is known as a small-sized, inexpensive developing system. In this one-component development, however, it is necessary to apply high linear pressure to toner particles using a regulating blade for stabilizing charging conveyance. As a result, a surface of a developing roller suffers filming of toner particles, which problematically shortens the service life of the developing roller. In order to solve this problem, there has been proposed a technique of preventing filming by improving releasability of a surface layer of the developing roller.

For example, for the purpose of providing an electroconductive roller which can provide a clear image even under severe printing conditions in a HH environment and which is especially effective to prevention of fogging on a white background, an invention of an electroconductive roller has been disclosed, which includes an elastic layer and at least one layer thereon, wherein the outermost layer is a layer where a fluorine-containing urethane resin has been added to an acrylic resin serving as a binder resin component (see Japanese Patent Application Laid-Open (JP-A) No. 2011-215467).

Such an improvement in releasability can prevent filming, but its improvement mechanism is due to localization of fluorine near the surface. Thus, an increased amount of fluorine near the surface relatively reduces charging sites near the surface. As a result, there has been a problem that even a small extent of filming tends to reduce charging.

SUMMARY OF THE INVENTION

The present invention aims to solve the above existing problems and achieve the following object. That is, an object of the present invention is to provide a developing roller which can prevent filming and involves a small extent of reduction in charges even when using toner particles having a core-shell structure and covered with an external additive at a high rate.

A means for solving the above problems is as follows.

Specifically, it is a developing roller, including: a shaft containing a metal; an elastic layer on a circumference of the shaft; and a surface layer on a circumferential surface of the elastic layer, wherein the surface layer contains: a polyurethane which is a reaction product between a fluoroethylene vinyl ether copolymer and an isocyanurate form of an isocyanate; and particles having an average primary particle diameter of 5 nm to 30 nm, and wherein the polyurethane has a peak intensity ratio of a NCO group to a hydroxyl group of 5.6 to 8.8 in an infrared absorption spectrum obtained by an attenuated total reflection method (ATR method).

According to the present invention, it is possible to provide a developing roller which can prevent filming and involves a small extent of reduction in charges even when using toner particles having a core-shell structure and covered with an external additive at a high rate. This can solve the existing problems and achieve the above object.

DETAILED DESCRIPTION OF THE INVENTION (Developing Roller)

A developing roller of the present invention includes a shaft containing a metal, an elastic layer on a circumference of the shaft, and a surface layer on a circumferential surface of the elastic layer; and, if necessary, further includes other members.

<Surface Layer>

The surface layer contains: a polyurethane which is a reaction product between a fluoroethylene vinyl ether copolymer and an isocyanurate form of an isocyanate; and particles having an average primary particle diameter of 5 nm to 30 nm, and the polyurethane has a peak intensity ratio of a NCO group to a hydroxyl group of 5.6 to 8.8 in an infrared absorption spectrum obtained by an ATR method.

Figure 1:
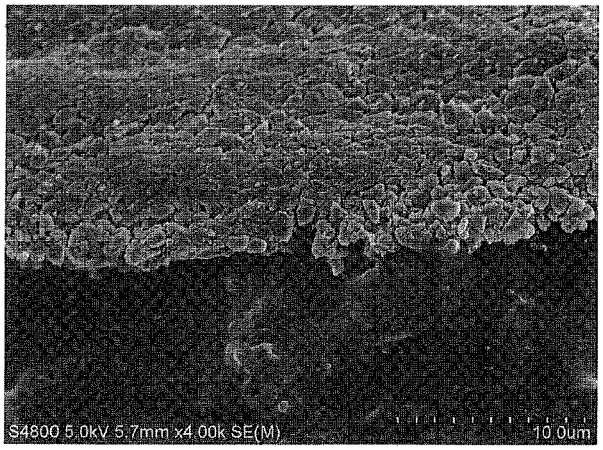
FIG. 1 illustrates one exemplary state where a surface of a developing roller has filming of toner particles.

Conventional, general developing rollers include a shaft (shaft member) and an elastic layer on a circumference of the shaft; and, if necessary, further include a surface layer. FIG. 1 illustrates one exemplary state where a surface of such a developing roller has filming of toner particles. In FIG. 1, a lower part that looks black is an elastic body around the shaft, and an upper part that looks slightly white is filming components covering the elastic body. Here, the filming components are aggregates formed of, for example, fine particles having a particle diameter of about 1 μm, shell-forming materials, and oil for treating additives.

In order to prevent the above filming, the present invention provides the surface of a developing roller with a surface layer formed of the above specific materials.

That is, in the surface layer in the present invention, a part of the polyurethane derived from the fluoroethylene vinyl ether copolymer has a high releaseability-imparting function by the action of fluorine and contributes to prevention of filming. Unless fluorine is localized in the surface, there is much urea in the surface. As a result, the releaseability-imparting effects by the action of fluorine cannot be obtained, and thus filming is accelerated to lead to a drastic reduction in effective charging sites. Note that, as described below, the polyurethane used in the present invention is produced with a formulation rich in NCO, and an only a part of the added NCO reacts with OH to form urethane, but most of the NCO remains as is. It is believed that the remaining NCO reacts with water to form amine and finally form urea.

In the present invention, in addition to the high releaseability-imparting function by the action of fluorine, the width of concave portions in fine convexoconcave formed in the surface of the surface layer is widen by the particles to make it easier for toner particles to roll on the surface of the surface layer, leading to further prevention of filming. As a result, the number and the area of contacts between the developing roller and toner particles increase both, leading to a smaller extent of reduction in charges on the surface of the developing roller.

Meanwhile, much filming causes charging sites on the surface of the developing roller to be covered with toner components. As a result, reduction in charges occurs. This reduction in charges makes it impossible to control movements of toner particles in an electrical field, and thus toner particles move to a non-developing portion on a photoconductor, causing background smear on the photoconductor.

In an infrared absorption spectrum obtained by measuring the polyurethane by an attenuated total reflection method (ATR method), the peak intensity ratio (NCO/OH) of a NCO group to a hydroxyl group is 5.6 to 8.8, preferably 6.4 to 8.0. When the peak intensity ratio falls outside the above defined range, releasability drops to lead to increased filming.

The fluoroethylene vinyl ether copolymer is not particularly limited and may be appropriately selected depending on the intended purpose. Examples thereof include trifluorinated fluororesins and tetrafluorinated fluororesins. From the viewpoints of dissolvability in solvents and reactivity with a curing agent, trifluorinated fluororesins are preferred, and trifluorinated monochlorinated fluororesins are particularly preferred.

Also, the isocyanate is not particularly limited and may be appropriately selected depending on the intended purpose. Examples thereof include hexamethylene diisocyanate, isophorone diisocyanate, and diphenylmethane diisocyanate. Among them, hexamethylene diisocyanate is preferred since it is an isocyanate having high solubility in organic solvents and having a symmetric structure to show equal reactivity, and it reacts with a polyol to easily form uniform/homogeneous urethane bonds.

The thickness of the surface layer (average thickness) is preferably about 0.1 μm to about 3 μm.

Note that, the thickness of each layer (average thickness) means an average of thicknesses measured at a plurality of points in the layer, preferably an average of thicknesses measured at 10 points, more preferably at 20 points.

The particles are not particularly limited and may be appropriately selected depending on the intended purpose. Examples thereof include silica particles, alumina particles, magnesium oxide particles, titanium particles, magnetite particles, and mixtures thereof. Considering sedimentation in a coating liquid, silica or alumina having a low specific gravity are preferred. Particularly preferred is silica hydrophobized with a hydrophobizing agent such as HMDS (hexamethyldisilazane), PDMS (polydimethylsiloxane) or DDS (dichlorodimethylsilane).

Note that, when silica is not hydrophobic, the silica may absorb moisture in a high-humidity environment to reduce the charge amount of toner particles. From this viewpoint, hydrophobized silica is preferred. The low charge amount of toner particles makes it impossible to control movements of toner particles in an electrical field, and thus toner particles move to a non-developing portion on a photoconductor, causing background smear on the photoconductor.

Examples of hydrophobizing methods include: a method in which a hydrophobizing agent is added to a dispersion liquid of silica particles, and they are allowed to react at 30° C. to 80° C. to perform a hydrophobizing treatment, followed by drying, to thereby obtain hydrophobized silica; and a method in which hydrophilic silica powder and a hydrophobizing agent are allowed to react in, for example, HENSCHEL MIXER under heating at about 100° C. to about 200° C., to thereby obtain hydrophobized silica.

The average primary particle diameter (i.e., number average particle diameter) of the particles is 5 nm to 30 nm, preferably 10 nm to 20 nm. Also, the smallest average primary particle diameter of available silica is 6 nm to 7 nm, and it is not possible to obtain smaller silica from the technical viewpoint.

The average primary particle diameter (number average particle diameter) of the particles can be determined as an average of particle diameters of 100 particles measured with a transmission electron microscope (TEM).

The width of a concave portion in fine convexoconcave in the surface of the surface layer is not particularly limited and may be appropriately selected depending on the intended purpose, but is preferably 2.0 μm to 3.0 μm on average.

The width (average) of a concave portion in fine convexoconcave can be determined as follows. Specifically, the surface of the surface layer is photographed at intervals of 0.1 μm using a laser microscope (product of KEYENCE CORPORATION) and a lens having a magnification of ×50, to thereby obtain a concave-convex profile, and peak-to-peak distances are measured at 100 places in the obtained concave-convex profile and are averaged.

<Shaft>

The shaft (shaft member) is generally in the form of an elongated right cylinder, and is formed of, for example, a metal (e.g., iron, an aluminum alloy, or stainless steel).

<Elastic Layer>

The elastic layer is generally formed of a rubber composition. Rubber components in the rubber composition are not particularly limited and may be appropriately selected depending on the intended purpose. Examples thereof include natural rubber, chloroprene rubber, styrene-butadiene rubber, ethylene-propylene rubber (EPDM), butyl rubber, acrylonitrile-butadiene rubber (NBR), isoprene rubber, silicone rubber, epichlorohydrin rubber, and urethane rubber.

The thickness of the elastic layer (average thickness) is preferably about 1 mm to about 10 mm.

The developing roller of the present invention is effective even when using toner particles having a core-shell structure and covered with an external additive at a high rate. Such toner particles having a core-shell structure are known, and their production methods and materials are not limited. Examples thereof include toner particles having a structure where toner base particles, which have been produced by a wet granulation method such as a suspension polymerization method, an emulsion aggregation association method, or a dissolution suspension method, are covered with, for example, a vinyl resin, a polyurethane resin, an epoxy resin, a polyester resin. Then, an external additive is further attached onto their surfaces to obtain toner particles. Note that, the toner particles covered with an external additive at a high rate refer to toner particles where a ratio of the projected area of the external additive to the surface area of the toner base is 150% or more. When this ratio is obtained, the toner base and the external additive are both assumed to be spherical particles having measured volume average particles diameters, and the areas of these spherical particles are used as the surface area of the toner base and the projected area of the external additive.

Developing Roller According to a Second Embodiment

In the developing roller according to a second embodiment of the present invention, a surface of the surface layer contains a plurality of streaky groove portions each extending along a circumferential direction of the developing roller and a plurality of protruded portions each extending along a direction of the rotational axis of the developing roller. This makes it possible to achieve improvements in, for example, adherence resistance, filming resistance, and stable charging conveyance.

In a developing device including the developing roller according to the second embodiment, when toner particles having an average circularity of 0.970 or more are used, toner particles in contact with a regulating blade rolls in the concave portions, and replacement of toner particles frequently occurs, whereby charging stability during durable printing can be ensured.

[Surface Structure of the Developing Roller]

Figure 2A:
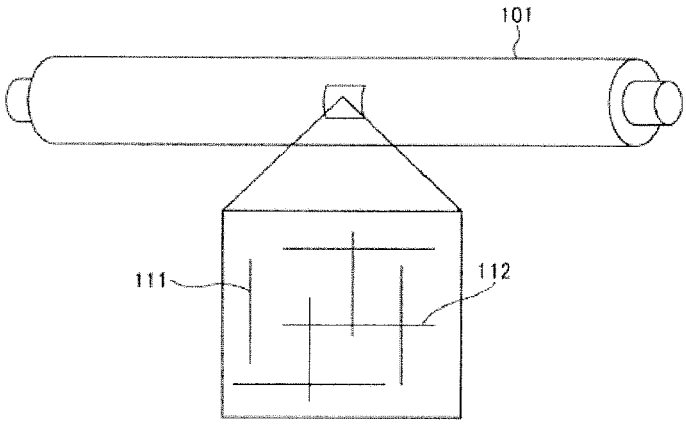
FIG. 2A exemplarily illustrates a surface structure of a developing roller according to a second embodiment.
Figure 2B:
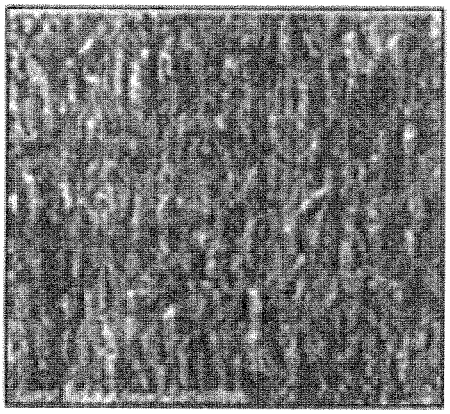
FIG. 2B is one exemplary enlarged view of a groove portion 111 in a surface of the developing roller illustrated in FIG. 2A.
Figure 2C:
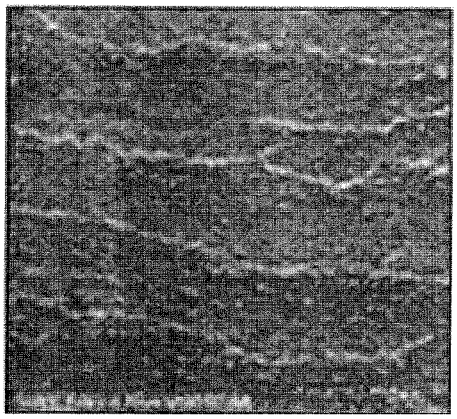
FIG. 2C is one exemplary enlarged view of a protruded portion 112 in a surface of the developing roller illustrated in FIG. 2A.

FIGS. 2A to 2C each exemplarily illustrate a surface structure of a developing roller 101 according to the second embodiment.

FIG. 2A is a schematic view which enlarges a part of the surface of the developing roller 101. As illustrated in FIG. 2A, a surface of the developing roller 101 has a plurality of streaky groove portions 111 each extending along a circumferential direction thereof and a plurality of protruded portions 112 each extending along a direction of the rotational axis thereof. FIG. 2B is one exemplary enlarged view of a groove portion 111 formed in the surface of the developing roller 101. FIG. 2C is one exemplary enlarged view of a protruded portion 112 in the surface of the developing roller 101. Throughout the entire surface of the developing roller 101, the groove portion 111 and the protruded portion 112 are formed so that they co-exist so as to be mixed.

One-component development gives toner particles large stress, for example, between the developing roller 101 and a layer thickness-regulating member 102, and between the developing roller 101 and a photoconductor 1. As a result, toner adherence to the layer thickness-regulating member 102, toner filming on the surface of the developing roller 101, and other problems may arise (see FIG. 5 referred to below).

Especially when a low temperature-fixing toner is used for achieving energy saving, such problems tend to arise easily. Also, when a toner containing a polishing agent is used to polish the layer thickness-regulating member 102 for preventing toner adherence, toner flowability will decrease to cause poor conformability to a solid image and failure in toner supply. As a result, its polishing effects will decrease not to obtain effects of polishing the layer thickness-regulating member 102, and toner adherence cannot be prevented in some cases.

In the developing roller 101 according to the second embodiment, the groove portion 111 formed in a circumferential direction increases the polishing effects of the polishing agent in the toner on the layer thickness-regulating member 102, which can prevent toner adherence from arising.

The protruded portion 112 formed in a direction of the rotational axis can efficiently convey toner particles supplied from a supply roller 103 to the layer thickness-regulating member 102, and contribute to improvement in stability of toner conveyance and improve poor conformability to a solid image.

The developing roller 101 has an effect of fluidizing toner particles near the layer thickness-regulating member 102 by the groove portion 111 and the protruded portion 112, and can prevent failure in toner supply which is a decrease in an amount of toner supplied to a developing portion between the developing roller 101 and the photoconductor 1.

As described above, in the developing device 100 including the developing roller 101 according to the second embodiment, since the developing roller 101 has the groove portion 111 and the protruded portion 112, even when using, for example, toner particles having a degree of aggregation, it is possible to prove conveyance of toner particles, adherence resistance, and filming resistance.

Figure 3A:
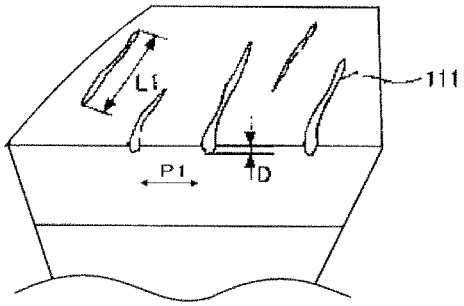
FIG. 3A is one exemplary view of a schematic structure of a surface of a developing roller according to a second embodiment.
Figure 3B:
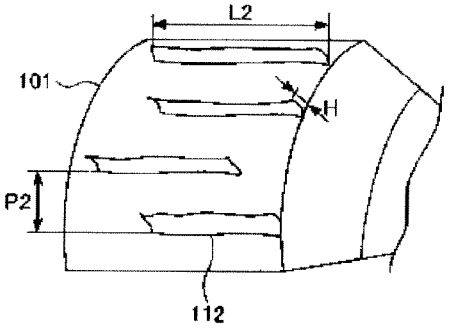
FIG. 3B is one exemplary view of a schematic structure of a surface of a developing roller according to a second embodiment.

FIGS. 3A and 3B exemplarily illustrate a schematic structure of a surface of the developing roller. FIG. 3A exemplarily illustrates a shape of the groove portion 111, and FIG. 3B exemplarily illustrates a shape of the protruded portion 112.

"L1" in FIG. 3A denotes a length of a groove portion 111 extending in the circumferential direction of the developing roller 101. "D" denotes a depth of the groove portion 111 from the surface of the developing roller 101, and "P1" denotes an interval (pitch) between the groove portions 111 adjacent to each other in the direction of the rotational axis in the surface of the developing roller 101.

The shape of a plurality of the streaky groove portions each extending along the circumferential direction is not particularly limited and may be appropriately selected depending on the intended purpose. An average of lengths L1 of the groove portions 111 in the circumferential direction is preferably 20 μm to 50 μm, more preferably 30 μm to 40 μm. An average of depths D of the groove portions is preferably 2 μm to 5 μm, more preferably 3 μm to 4.5 μm. An average of the pitches P1 between the groove portions is preferably 10 μm to 50 μm, more preferably 20 μm to 40 μm. When a surface of the developing roller has convexoconcave appropriate with respect to the particle diameter of toner particles, the developing roller gives toner particles kinetic energy to increase the number of contacts between the toner particles and the developing roller, resulting in obtaining an effect of stabilizing the charge amount of toner particles.

"L2" in FIG. 3B is a length of the protruded portion 112 extending along the direction of the rotational axis of the developing roller 101. "H" denotes a height of the protruded portion 112 from the surface of the developing roller 101, and "P2" denotes an interval (pitch) between the m protruded portions 112 adjacent to each other in the circumferential direction in the surface of the developing roller 101.

The shape of a plurality of protruded portions each extending along the direction of the rotational axis is not particularly limited and may be appropriately selected depending on the intended purpose. An average of lengths L2 of the protruded portions 112 in the direction of the rotational axis is preferably 50 μm to 500 μm, more preferably 100 μm to 300 μm. An average of heights H is preferably 2 μm to 5 μm, more preferably 3 μm to 4.5 μm. An average of the pitches P2 is preferably 50 μm to 200 μm, more preferably 80 μm to 180 μm.

The streaky groove portions each extending along the circumferential direction can be formed by, for example, pressing a polishing member against a rotating roller in a state where the polishing member is fixed or is rotated in an opposite direction to the direction of the rotation of the roller.

The protruded portions each extending along the direction of the rotational axis can be formed by, for example, fixing a roller and moving a polishing member along the direction of the rotational axis of the fixed roller.

[Measurement of the Shapes of the Groove Portions and the Protruded Portions]

The length L1 and the pitch P1 of the groove portions, and the length L2 and the pitch P2 of the protruded portions can be measured by the following method, for example.

First, scanning electron microscope S-4800 (product of Hitachi High-Tech Manufacturing & Service Corporation) is used at a magnification of ×2,000 to photograph five places of the developing roller (in the direction of the shaft, both the end portions, central portion, and two middle portions between the central portion and both the end portions). Next, 10 groove portions and 10 protruded portions are extracted from each of the photographs of the five places to measure lengths L1, pitches P1, lengths L2, and pitches P2.

The measured values are averaged to obtain the length L1, the pitch P1, the length L2, and the pitch P2.

The depth D of the groove portions can be measured by the following method, for example. First, the developing roller is cut along the direction of its shaft to prepare a cross-section, and scanning electron microscope S-4800 (product of Hitachi High-Tech Manufacturing & Service Corporation) is used at a magnification of ×2,000 to photograph five places of the developing roller (in the direction of the shaft, both the end portions, central portion, and two middle portions between the central portion and both the end portions). Next, 10 groove portions are extracted from each of the photographs of the five places to measure their depths, and the measured values are averaged to obtain the depth D of the groove portions.

Note that, the depth D of less than 2.0 μm is considered that a groove portion is not formed.

[Height of the Protruded Portion]

The height of the protruded portion can be formed by the following method, for example.

First, the developing roller is cut along a perpendicular direction to the direction of the shaft at five places (in the direction of the shaft, both the end portions, central portion, and two middle portions between the central portion and both the end portions).

Next, scanning electron microscope S-4800 (product of Hitachi High-Tech Manufacturing & Service Corporation) is used at a magnification of ×2,000 to photograph five places of the developing roller. Then, 10 protruded portions 112 are extracted from each of the photographs of the five places to measure their heights of the protruded portions 112, and the measured values are averaged to obtain the height H of the protruded portions.

Note that, the height H of less than 1.5 μm is considered that a protruded portion is not formed.

(Developing Device)

A developing device of the present invention includes the developing roller of the present invention; and, if necessary, further includes other members.

The developing device is a one-component developing device including: a toner; a toner-conveying unit configured to convey the toner; and a regulating unit configured to regulate a thickness of a layer of the toner supplied to a surface of the toner-conveying unit. The toner-conveying unit preferably includes the developing roller of the present invention. Also, the toner preferably has an average circularity of 0.970 or more.

A developing device according to a second embodiment a developing device including the developing roller according to the second embodiment. The developing device according to the second embodiment a one-component developing device including: a toner; a toner-conveying unit configured to convey the toner; and a regulating unit configured to regulate a thickness of a layer of the toner supplied to a surface of the toner-conveying unit. The toner-conveying unit includes the developing roller of the present invention, and the toner has an average circularity of 0.970 or more.

The developing device according to the second embodiment can provide a developing roller for one-component development which is sufficiently low cost and is excellent in adherence resistance, filming resistance, and stability in charging conveyance, and can ensure charging stability during durable printing.

Like the developing roller used in the second embodiment, in the developing roller having a surface containing a plurality of streaky groove portions each extending along a circumferential direction thereof and a plurality of protruded portions each extending along a direction of the rotational axis thereof, it becomes more difficult for toner particles to roll particularly in concave portions, and replacement of toner particles does not occur to cause degraded charging stability. Moreover, in one-component development, most of the particles that actually pass through a regulating unit (e.g., a regulating blade) are 7 μm or less in particle diameter. Also, toner particles having a particle diameter of less than 3 μm are too small to contact a regulating blade. Therefore, when using such a developing roller, it is particularly effective in terms of charging stability to increase the circularity of toner particles having a particle diameter of 3 μm to 7 μm to make it easier for toner particles to roll.

According to the second embodiment, it is possible to favorably ensure charging stability during durable printing when using a developing roller having a surface containing a plurality of streaky groove portions each extending along a circumferential direction thereof and a plurality of protruded portions each extending along a direction of the rotational axis thereof.

(Process Cartridge)

A process cartridge of the present invention includes an image bearing member, and the developing roller or the developing device of the present invention; and, if necessary, further includes other units. The process cartridge is attachable or detachable to a main body of an image forming apparatus. The process cartridge particularly exhibits its effects in contact, one-component development, especially when toner particles having a core-shell structure and covered with an external additive at a high rate are used under high regulating pressure. Under such conditions, shell-forming materials and free external additives are peeled off from the surfaces of the toner particles to form aggregates, which cause filming on their contact members to reduce the functions of the members. The developing roller of the present invention does not cause filming even under such conditions, and can use a much wider range of toner particles with a variety of formulations. Hence, the process cartridge including combinations of this developing roller and toners also comes to have a broader range of applications.

(Image Forming Apparatus and Image Forming Method)

An image forming apparatus of the present invention includes the developing roller, the developing device, or the process cartridge of the present invention; and, if necessary, further include other units. For example, the image forming apparatus includes an image bearing member (which may be referred to as "electrostatic latent image bearing member" or "photoconductor"), an electrostatic latent image-forming unit, and a developing unit (i.e., the developing roller of the present invention); and, if necessary, further includes other units.

An image forming method using the developing roller, the developing device, or the process cartridge of the present invention includes an electrostatic latent image-forming step and a developing step; and, if necessary, further includes other steps.

In the image forming apparatus or the image forming method, limitations on toners become very smaller by the properties of the developing roller of the present invention, which results in widening employable image forming conditions including not only developing but also fixing.

Referring now to the drawings, the image forming apparatus and the process cartridge of the present invention will be described. Across the drawings, the same members are indicated by the same symbols. Also, when explanations for the members are overlapped, the overlapped explanation may be omitted.

[Configuration of the Image Forming Apparatus]

Figure 4:
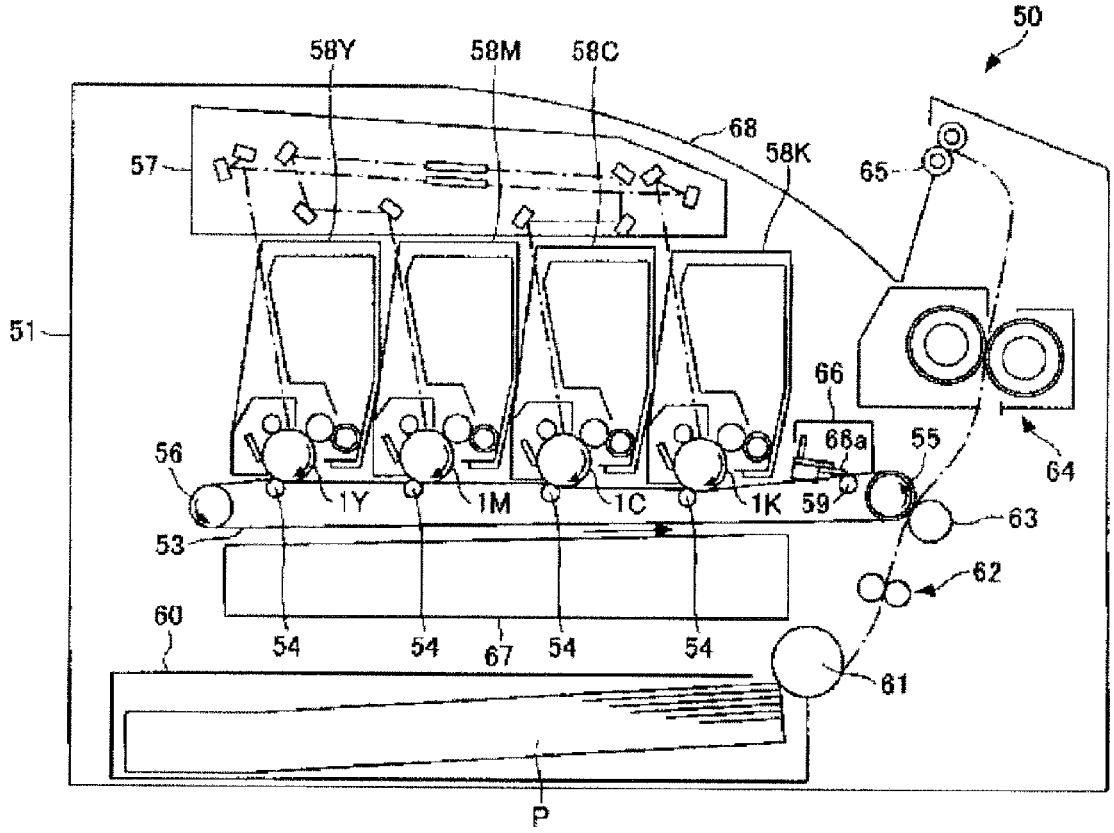
FIG. 4 is one exemplary view of a schematic configuration of an image forming apparatus according to an embodiment.

First, referring to FIG. 4, the entire configuration and operations of an image forming apparatus 50 for one-component development according to an embodiment will be described. FIG. 4 is a schematic view of one exemplary inner configuration of the image forming apparatus 50. Note that, the image forming apparatus 50 according to the present embodiment is a color printer, but may be a monochromatic or color facsimile, printer, or multifunction peripheral.

As illustrated in FIG. 4, the image forming apparatus 50 includes a main body frame 51 and four process cartridges 58K, 58C, 58M, and 58Y arranged at a central portion thereof. Also, an exposing device 57 is provided above the process cartridges 58K, 58C, 58M, and 58Y for forming latent images on photoconductors 1K, 1C, 1M, and 1Y. A black toner image, a cyan toner image, a magenta toner image, and a yellow toner image are formed on surfaces of the photoconductors 1K, 1C, 1M, and 1Y, respectively.

The process cartridges 58K, 58C, 58M, and 58Y have the same configuration except that the colors of toners used as a developer are different. Hereinafter, the symbols indicating colors will be omitted and the process cartridges 58K, 58C, 58M, and 58Y will be described as a process cartridge 58. Similarly, the symbols indicating colors will be omitted also in the photoconductors 1K, 1C, 1M, and 1Y, and they will be described as a photoconductor 1.

Figure 5:
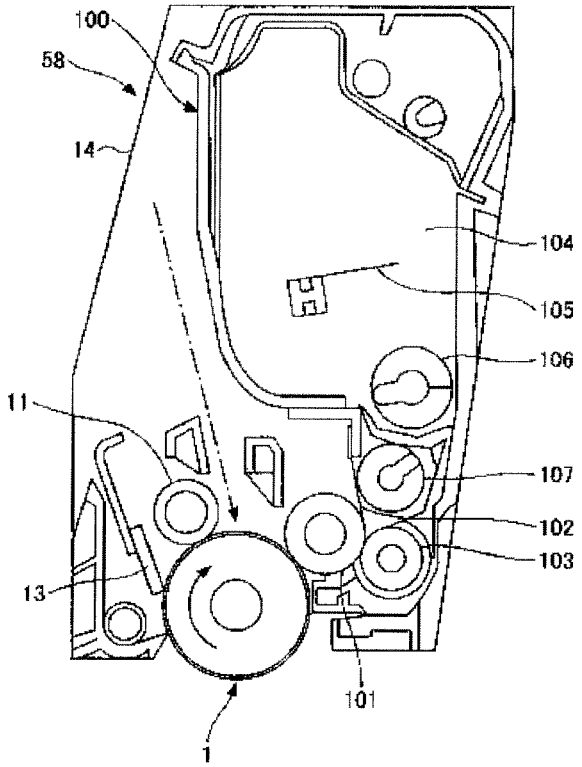
FIG. 5 is one exemplary view of a schematic configuration of process cartridge according to an embodiment.

As illustrated in FIG. 5, the process cartridge 58 includes a frame 14, and in this frame, a photoconductor 1, a charging roller 11, a cleaning blade 13, and a developing device 100. The process cartridge 58 is mounted via the frame 14 in an attachable and detachable manner to the main body frame 51 which is a main body of the image forming apparatus 50.

The charging roller 11 is pressed against the surface of the photoconductor 1, and rotated in accordance with the rotation of the photoconductor 1 that is rotating. In this state, the charging roller 11 applies a DC bias or a bias of AC superposed on DC with a high-voltage power supply, to thereby uniformly charge the surface of the photoconductor 1 at −1,000 V to −200 V, for example.

The developing device 100 includes a developing roller 101, a layer thickness-regulating member 102 serving as the regulating unit, a supply roller 103, a toner container chamber 104, a stirring member 105, and stirring conveying screws 106 and 107.

A toner housed in the toner containing chamber 104 is stirred and loosened by the stirring member 105 that is rotating. In this state, the toner is conveyed by the stirring conveying screws 106 and 107 to the supply roller 103. The supply roller 103 supplies the toner attached on its surface to a surface of the developing roller 101.

The developing roller 101 bears toner particles supplied from the supply roller 103 and rotates. The toner particles on the surface of the developing roller 101 are formed into a thin layer by the layer thickness-regulating member 102 and a charged toner layer is formed. A developing bias is applied to the developing roller 101 from a high-voltage power supply, to thereby form an electrical field between the developing roller 101 and the photoconductor 1 that abuts the developing roller 101. In this state, the developing roller 101 supplies the toner particles to an electrostatic latent image on the surface of the photoconductor 1 to thereby form a toner image.

A free end of the layer thickness-regulating member 102 is pressed against the surface of the developing roller 101, and the layer thickness-regulating member 102 forms a thin layer of toner particles passing through a space between the layer thickness-regulating member 102 and the developing roller 101, and charges the toner particles by frictional charging.

A developing electrical field is formed between the developing roller 101 and the photoconductor 1, and the toner particles are supplied from the toner layer on the surface of the developing roller 101 to the electrostatic latent image on the surface of the photoconductor 1, to thereby form a toner image on the surface of the photoconductor 1.

As illustrated in FIG. 4, an intermediate transfer belt 53 is provided below the process cartridge 58. The intermediate transfer belt 53 is stretched around a primary transfer roller 54, a driving roller 55 also serving as a secondary transfer counter roller, a cleaning counter roller 59, and a driven roller 56 also serving as a tension roller, and is rotated in accordance with the driving roller 55.

The toner mages formed on the surfaces of the photoconductors 1 are transferred on the intermediate transfer belt 53 in a superposed manner by the action of transfer electrical fields formed between the photoconductors 1 and the primary transfer rollers 54, to thereby form a color toner image.

A paper feeding cassette 60 housing sheets of paper P serving as recording media is provided below the intermediate transfer belt 53. The sheet of paper P is conveyed by, for example, a paper feeding roller 61 and a conveying roller 62, and when it passes through a space between a secondary transfer roller 63 and the intermediate transfer belt 53, the toner image on the intermediate transfer belt 53 is secondarily transferred. The toner particles remaining on the surface of the intermediate transfer belt 53 after the toner image has been transferred onto the sheet of paper P are scraped off by a blade 66*a* of a cleaning device 66 and collected in a toner-collecting device 67.

The sheet of paper P having the toner image on the surface thereof is heated and pressed when passing through a fixing device 64, so that the toner image is fixed on the surface of the sheet of paper P, which is then discharged by a paper-discharging roller 65 to a discharging tray 68.

With the above-described configuration and operations, the image forming apparatus 50 prints an image on sheets of paper P and discharges the sheets outside thereof. Note that, the image forming apparatus is not limited to the configuration of the present embodiment, and may be configured such that a toner image is directly transferred from the photoconductor 1 to the sheets of paper P, for example.

<Toner>

The toner usable is a toner having a degree of aggregation of 50% to 90%, but the degree of aggregation of the toner is more preferably 70% to 85%. In the second embodiment, the protruded portions 112 in the surface of the developing roller 101 have an effect of stirring toner particles to improve circulation of the toner particles.

As described above, the developing roller according to the second embodiment has protruded portions in the direction of the rotation thereof. The protruded portions can effectively deliver the toner particles supplied from the supply roller to a regulating portion. Therefore, the protruded portions contribute to improvement in stability of toner conveyance and can improve poor conformability to a solid image.

Meanwhile, the groove portions of the developing roller in the circumferential direction effectively enable a toner polishing agent to polish the regulating blade with adherence of toner particles at a regulating part, and also have a function of improving flowability of toner particles in their grooves (concave portions) to enable prevention of filming. That is, the surface shape having both the protruded portions and groove portions can mutually compensate for their disadvantages while ensuring improving effects of both of the shapes.

Also, it has been found that failure in toner supply is improved. The failure in toner supply is a phenomenon that the amount of toner supplied from a toner supply paddle is short and as a result the density of a solid image becomes lower toward its rear end so that the low density area becomes broader. It is not clear why such supply failure has been improved despite the fact that the amount of the toner supplied from the paddle is unchanged. However, it is believed that the rotation of the developing roller having great differences in height between the protruded portions and the groove portions promotes flowability of toner particles in a region before the regulating part, and as a result the amount of toner particles conveyed by the developing roller to the regulating part has increased.

However, in the developing roller according to the second embodiment, it becomes more difficult for toner particles to roll particularly in concave portions, and replacement of toner particles does not occur to cause degraded charging stability during durable printing.

In order to solve the above problem, necessary to make it easier for toner particles to roll. In order to make it easier for toner particles to roll, it is necessary to increase the circularity of toner particles.

Moreover, in one-component development, most of the particles that actually pass through a regulating unit are 7 μm or less in particle diameter. Also, toner particles having a particle diameter of less than 3 μm are too small to contact a regulating blade. Therefore, when using such a developing roller, it is particularly effective in terms of charging stability to increase the circularity of toner particles having a particle diameter of 3 μm to 7 μm to make it easier for toner particles to roll.

Therefore, the developing device of the present invention (especially, the developing device of the second embodiment) uses toner particles having an average circularity of 0.970 or more, preferably toner particles having a particle diameter of 3 μm or more but less than 7 μm and an average circularity of 0.970 or more.

More preferably, in the toner particles used in the developing device of the present invention, the proportion of particles having a particle diameter of 3 μm to 7 μm and a circularity of 0.985 or more is 40% or more. When the proportion of particles having a circularity of 0.985 or more is 40% or more, it is possible to reduce the difference between the initial charge amount and the charge amount after durable printing.

The toner particles having an average circularity of 0.970 or more used in the present invention can be produced by the dissolution suspension method, for example. Hereinafter, a method for producing a toner by the dissolution suspension method will be described.

[Dissolution Suspension Method]

In one exemplary method for producing a toner by the dissolution suspension method, a toner composition containing at least a resin and a colorant is dissolved or dispersed in an organic solvent to prepare a solution or dispersion liquid; the resultant solution or dispersion liquid is dispersed in an aqueous solvent in the presence of a dispersing agent using, for example, an usual stirrer, homomixer or homogenizer so that the formed toner particles can have a desired particle size distribution; and the organic solvent is removed to obtain a toner slurry. The toner can be isolated by a known process including: collecting through washing and filtrating; and drying.

—Resin—

Any resin can be used for the production by the dissolution suspension method so long as it can be dissolved in a solvent. Examples of the resin include resin conventionally used for toner. Specific examples thereof include polyester resins, styrene-acryl resins, polyol resins, vinyl resins, polyurethane resins, epoxy resins, polyamide resins, polyimide resins, silicone resins, phenol resins, melamine resins, urea resins, aniline resins, ionomer resins and polycarbonate resins. Among them, polyester resins are suitably used from the viewpoint of obtaining good fixing property.

—Organic Solvent—

The organic solvent used is preferably an organic solvent having a boiling point lower than 100° C. from the viewpoint of allowing easy removal. Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination of two or more thereof.

The aqueous phase preparation step is a step of preparing an aqueous phase containing an aqueous medium.

The aqueous solvent may be water alone, or a mixture of water and a water-miscible solvent. Examples of the water-miscible solvent include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone). The amount of the aqueous solvent is generally 50 parts by mass to 2,000 parts by mass, preferably 100 parts by mass to 1,000 parts by mass, per 100 parts by mass of the toner materials. Use of the aqueous medium in an amount of less than 50 parts by mass may lead to degradation in the dispersion state of the toner materials. Use of the aqueous medium in an amount of more than 2,000 parts by mass is not economical.

—Colorant—

The toner of the present invention may contain known colorants conventionally used for full-color toners. Examples of the colorant include carbon black, aniline blue, carcoil blue, chromium yellow, ultramarine blue, Du Pont oil red, quinoline yellow, methylene blue chloride, copper phthalocyanine, malachite green oxalate, lamp black, rose bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. pigment yellow 74, C.I. solvent yellow 162, C.I. pigment yellow 180, CI. pigment yellow 185, C.I. pigment blue 15:1 and C.I. pigment blue 15:3. The amount of the colorant contained in each toner particle is preferably 2 parts by mass to 15 parts by mass per 100 parts by mass of all of the resin. From the viewpoint of its dispersibility, the colorant is preferably used in the form of masterbatch where it is dispersed in a binder resin mixture containing a first binder resin and a second binder resin used. The amount of the masterbatch added is not particularly limited so long as the amount of the colorant contained falls within the above range. The amount of the colorant contained in the masterbatch is preferably 20% by mass to 40% by mass.

[Production Method]

Next, the production process will be described.

—Oil Phase Preparation Step—

In one employable means for preparing an oil phase where the resin, the colorant, and other materials are dissolved or dispersed in an organic solvent, the resin, the colorant, and other materials are gradually added to the organic solvent under stirring so that these materials are dissolved or dispersed therein. Note that, when a material poorly dissolvable in the organic solvent is used; for example, when a pigment is used as the colorant, the particles of these materials may be made small before the addition to the organic solvent.

In another means, when dispersing the materials melted at a temperature lower than the boiling point of the organic solvent, they are heated under stirring in the organic solvent, if necessary in the presence of a dispersing aid to be stirred together with the dispersoids; and the resultant solution is cooled with stirring or shearing so that the dissolved materials are crystallized, to thereby produce microcrystals of the dispersoids.

After the colorant and other materials which have been dispersed by the above means are dissolved or dispersed together with the resin in the organic solvent, the resultant solution or dispersion liquid may further be dispersed. The dispersion may be performed using a known dispersing device such as a bead mill or a disc mill.

—Toner Base Particles Preparation Step—

A method for dispersing the oil phase obtained in the above-describes step in an aqueous medium to prepare a dispersion liquid where toner base particles formed of the oil phase are dispersed is not particularly limited and may be performed by a known dispersing device such as a low-speed shearing dispersing device, a high-speed dispersing shearing device, a frictional dispersing device, a high-jet dispersing device, or an ultrasonic dispersing device. Use of a high-speed shearing dispersing device is preferable for controlling the particle diameter of the dispersoids within the range of 2 μm to 20 μm. When the high-speed shearing dispersing device is used, its number of rotations is not particularly limited but is generally 1,000 rpm to 30,000 rpm, preferably 5,000 rpm to 20,000 rpm.

Applying shearing force can adjust the average circularity of the toner particles at the same time as the proportion of particles having a particle diameter of 3 μm or more but less than 7 μm and a circularity of 0.970 or more.

Increased shearing force decreases the average circularity and also decreases the proportion of particles having the circularity of 0.970 or more. Decreased shearing force increases the average circularity and also increases the proportion of particles having the circularity of 0.970 or more.

The time for which the dispersion is performed is generally 0.1 min to 5 min in a batch method. When the dispersion is performed longer than 5 min, unwanted small particles remain and an excessively dispersed state is established to make the dispersion system unstable, potentially forming aggregates and coarse particles, which is not preferred.

The temperature at which the dispersion is generally 0° C. to 40° C., preferably 10° C. to 30° C. When it is higher than 40° C., molecular movements are excited to degrade dispersion stability, easily forming aggregates and coarse particles, which is not preferred. Whereas when it is lower than 0° C., the dispersion liquid is increased in viscosity to require elevated shearing energy for dispersion, leading to a drop in production efficiency.

Examples of the surfactant include anionic surfactants such as alkylbenzenesulfonic acid salts, α-olefin sulfonic acid salts, and phosphoric acid esters; cationic surfactants such as amine salts (e.g., alkyl amine salts, aminoalcohol fatty acid derivatives, polyamine fatty acid derivatives, and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl)glycine, di(octylaminoethyl) glycine, and N-alkyl-N,N-dimethylammonium betaine.

From the viewpoint of efficiently dispersing the oil droplets containing the solvent, the surfactant used is preferably a disulfonic acid salt having a higher HLB. The amount of the surfactant contained in the aqueous medium is preferably 1% by mass to 10% by mass, preferably 2% by mass to 8% by mass, more preferably 3% by mass to 7% by mass. When it is more than 10% by mass, each oil droplet becomes too small and/or has a reverse micellar structure and as a result the dispersion stability is degraded due to the surfactant added in such an amount to cause coarse oil droplets, which is not preferred. Whereas when it is less than 1% by mass, the oil droplets cannot be stably dispersed and as a result coarse oil droplets may be formed, which is not preferred.

—Desolvation Step—

In one employable means for removing the organic solvent from the obtained colored resin dispersion liquid, the entire system is gradually increased in temperature with stirring, to thereby completely evaporate off the organic solvent contained in the liquid droplets.

In another employable means, the obtained colored resin dispersion liquid under stirring is sprayed toward a dry atmosphere, to thereby completely evaporate off the organic solvent contained in the liquid droplets. In still another employable means, the colored resin dispersion liquid is reduced in pressure with stirring to evaporate off the organic solvent. The latter two means may be used in combination with the first means.

The dry atmosphere toward which the emulsified dispersion liquid is sprayed generally uses heated gas (e.g., air, nitrogen, carbon dioxide and combustion gas), especially, gas flow heated to a temperature equal to or higher than the highest boiling point of the solvents used. By removing the organic solvent even in a short time using, for example, a spray dryer, a belt dryer or a rotary kiln, the resultant product can have satisfactory qualities.

—Aging Step—

When a modified resin having an end isocyanate group is added, an aging step may be performed for allowing elongation/crosslinking reaction of the isocyanate to proceed. The time for which the aging is performed is generally 10 min to 40 hours, preferably 2 hours to 24 hours. The reaction temperature for the aging is generally 0° C. to 65° C., preferably 35° C. to 50° C.

—Washing Step—

Since the dispersion liquid of the colored resin particles obtained in the above-described method contains not only the colored resin particles but also such subsidiary materials as the dispersing agent such as the surfactant, washing is performed for separating the colored resin particles from the subsidiary materials. Examples of the method for washing the colored resin particles include a centrifugation method, a reduced-pressure filtration method and a filter press method, but a method employable in the present invention is not limited thereto. Any of the above methods forms a cake of the colored resin particles. When the colored resin particles are not sufficiently washed through only one washing process, the formed cake may be dispersed again in an aqueous solvent to form a slurry, which is repeatedly treated with any of the above methods to taken out the colored resin particles. When a reduced-pressure filtration method or a filter press method is employed for washing, an aqueous solvent may be made to penetrate the cake to wash out the subsidiary materials contained in the colored resin particles. The aqueous solvent used for washing is water, or a solvent mixture of water and an alcohol such as methanol or ethanol. Use of water is preferred from the viewpoint of reducing cost and environmental load caused by, for example, drainage treatment.

—Drying Step—

Since the washed colored rein particles contain the aqueous medium in a large amount, drying is performed for removing the aqueous medium, so that only the colored resin particles can be obtained. The drying can be performed using a dryer such as a spray dryer, a vacuum freezing dryer, a reduced-pressure dryer, a ventilation shelf dryer, a movable shelf dryer, a fluidized-bed-type dryer, a rotary dryer, or a stirring-type dryer. The colored resin particles are preferably dried until the water content is finally decreased less than 1% by mass.

—Beating Step—

When the toner particles dried flocculate to cause inconvenience in use, the flocculated particles may be separated from each other through beating using a device such as a jet mill, HENSCHEL MIXER, a super mixer, a coffee mill, an osier blender, or a food processor.

[Average Circularity of Toner Particles]

The average circularity of the toner particles can be measured, for example, in the following manner using a flow particle image analyzer "FPIA-3000" (product of Sysmex Corporation) under measurement and analysis conditions in calibration work.

The measurement of the average circularity is performed using the above flow particle image analyzer with "UPlanApro" (magnification: ×10, numerical aperture: 0.40) mounted as an objective lens, and particle sheath "PSE-900A" (product of Sysmex Corporation) is used as a sheath liquid.

The dispersion liquid prepared according to the above-described procedure is introduced into the above flow particle image analyzer, where 3,000 toner particles are measured at a HPF measurement mode and a total count mode.

And, a threshold of binarization in particle analysis is set to 85% and a particle diameter to be analyzed is limited to the range of 2.0 μm or more but less than 200.00 μm as a circle-equivalent diameter, and then the average circularity of the toner particles is measured. In addition, the proportion of particles having a particle diameter of 3.0 μm to 7.0 μm and a circularity of 0.985 or more is calculated. In order to reduce error within a sample, the same sample is measured at 5 times, and an average of the measurements is used.

Note that, before the beginning of the measurement, autofocus adjustment is performed using standard latex particles (e.g., a dilution of "RESEARCH AND TEST PARTICLES Latex Microsphere Suspensions 5200A" (product of Duke Scientific Corporation) with ion-exchange water). Thereafter, t is preferred to perform focus adjustment every 2 hours from the beginning of the measurement.

EXAMPLES

The present invention now will be more specifically described with reference to Examples and Comparative Examples, but the present invention is not limited to Examples. Note that, unless otherwise noted, "part(s)" and "%" in Examples mean "part(s) by mass" and "% by mass", respectively.

Example 1

Epichlorohydrin rubber (HYDRIN T3106, product of Zeon Corporation) was extruded onto a metal shaft (SUS) having a diameter of 8 cm so that the rubber had an average thickness of 4 mm, to thereby be formed into a roller. The resultant roller was stored under an environment of 150° C. for 90 min, followed by vulcanizing. Then, a surface of the vulcanized roller was subjected to a coarse polishing by a polishing machine (LEO600-F4L-BME, product of MINAKUCHI MACHINERY WORKS LTD.) until the surface roughness Ra was 1.5 μm and further subjected to a finish polishing by SZC (product of MINAKUCHI MACHINERY WORKS LTD.) using wrapping film #30 under the following conditions: with oscillation, traverse feed velocity: 600 mm/s, tape feed velocity: 25 mm/s, the number of revolutions of the rubber roller: 1,000 rpm, and 1 pass-polishing, to thereby obtain a rubber substrate for a developing roller (a substrate in which an elastic layer is provided on a circumference of a metal shaft).

Then, a material mixture for a surface layer containing 9 parts of ethyl acetate, 1 part of butyl acetate, 0.1097 parts of a fluoroethylene vinyl ether copolymer (LF-200, product of ASAHI GLASS CO., LTD.), 1.0000 part of isocyanurate (D170N, an isocyanurate form of hexamethylene diisocyanate, product of Mitsui Chemicals, Inc.), 0.2200 parts of carbon black (ACL-4, product of Fuji Pigment Co., Ltd.), and 0.0220 parts of hydrophobic silica (H20™, particles having an average primary particle diameter of 10 nm to 20 nm, product of Clariant International Ltd.) was stirred with a roll mill for 60 min. Thereafter, 0.1000 parts of a catalyst (NEOSTANN U-820, product of Nitto Kasei Co., Ltd.) was added thereto, followed by stirring for 1 min, to thereby prepare a toner bearing layer coating liquid.

Then, the coating liquid was sprayed onto a surface of the rubber substrate for a developing roller by a spray coater (product of ATMAX, INC.), followed by storing at 150° C. for 1 hour to thereby obtain a developing roller of Example 1 of which surface layer (toner bearing layer) had an average thickness of 4 μm.

Example 2

A developing roller of Example 2 was obtained in the same manner as in Example 1, except that the silica was changed to hydrophobic silica R976S (product of Nippon Aerosil Co., Ltd., average primary particle diameter: 5 nm to 7 nm), and the fluoroethylene vinyl ether copolymer was changed to 0.0290 parts of a fluoroethylene vinyl ether copolymer (LF916, product of ASAHI GLASS CO., LTD.).

Example 3

A developing roller of Example 3 was obtained in the same manner as in Example 1, except that the silica was changed to hydrophobic silica NAX50 (product of Nippon Aerosil Co., Ltd., average primary particle diameter: 20 nm to 30 nm), and the fluoroethylene vinyl ether copolymer was changed to 0.0991 parts of a fluoroethylene vinyl ether copolymer (LF600, product of ASAHI GLASS CO., LTD.).

Example 4

A developing roller of Example 4 was obtained in the same manner as in Example 3, except that the silica was changed to silica (STT30S, product of Titan Kogyo, Ltd., average primary particle diameter: 10 nm to 20 nm).

Example 5

A developing roller of Example 5 was obtained in the same manner as in Example 3, except that the silica was changed to silica (EPOSTAR MX020W, product of NIPPON SHOKUBAI CO., LTD., average primary particle diameter: 10 nm to 30 nm).

Example 6

A developing roller of Example 6 was obtained in the same manner as in Example 3, except that the isocyanurate was changed to isocyanurate (D-127N, an isocyanurate form of 1,3-bis(isocyanatomethyl) cyclohexane, product of Mitsui Chemicals, Inc.), the amount of the fluoroethylene vinyl ether copolymer LF600 was changed to 0.1231 parts, and the silica was changed to hydrophobic silica (R972, product of Nippon Aerosil Co., Ltd., average primary particle diameter: 16 nm).

Example 7

A developing roller of Example 7 was obtained in the same manner as in Example 3, except that the amount of the fluoroethylene vinyl ether copolymer LF600 was changed to 0.0930 parts, and the silica was changed to hydrophobic silica (R972, product of Nippon Aerosil Co., Ltd.).

Example 8

A developing roller of Example 8 was obtained in the same manner as in Example 3, except that the amount of the fluoroethylene vinyl ether copolymer LF600 was changed to 0.1150 parts, and the silica was changed to hydrophobic silica (R972, product of Nippon Aerosil Co., Ltd.).

Example 9

A developing roller of Example 9 was obtained in the same manner as in Example 3, except that the silica was changed to alumina (Alu130, product of Nippon Aerosil Co., Ltd., average primary particle diameter: 10 nm to 20 nm).

Example 10

A developing roller of Example 10 was obtained in the same manner as in Example 1, except that the conditions under which the substrate was polished were changed to as follows. The coarse polishing was performed by LEO600-F4L-BME until the surface roughness Ra was 1.0 μm, and then the finish polishing was performed by SLC under the following conditions: tape roughness: 20 μm, the number of revolutions of the rubber roller: 800 rpm, 2 pass-polishing, tape feed velocity: 25 mm/s, with oscillation, and traverse feed velocity: 700 mm/s.

Example 11

A developing roller of Example 11 was obtained in the same manner as in Example 3, except that the silica was changed to (R972, product of Nippon Aerosil Co., Ltd.).

Example 12

A developing roller of Example 12 was obtained in the same manner as in Example 1, except that the silica was changed to (R972, product of Nippon Aerosil Co., Ltd.).

Comparative Example 1

A developing roller of Comparative Example 1 was obtained in the same manner as in Example 3, except that the silica was changed to silica (RX50, product of Nippon Aerosil Co., Ltd., average primary particle diameter: 40 nm).

Comparative Example 2

A developing roller of Comparative Example 2 was obtained in the same manner as in Example 3, except that the isocyanurate was changed to D101 (difunctional isocyanate, product of Asahi Kasei Chemicals Corp.), and the amount of the fluoroethylene vinyl ether copolymer was changed to 0.0940 parts.

Comparative Example 3

A developing roller of Comparative Example 3 was obtained in the same manner as n Example 3, except that the isocyanurate was changed to D160N (TMP adduct form of isocyanate, product of Mitsui Chemicals, Inc.), the amount of the fluoroethylene vinyl ether copolymer was changed to 0.0492 parts, and the silica was changed to hydrophobic silica (R972, product of Nippon Aerosil Co., Ltd.).

Comparative Example 4

A developing roller of Comparative Example 4 was obtained in the same manner as in Example 3, except that the amount of the fluoroethylene vinyl ether copolymer was changed to 0.0849 parts, and the silica was changed to hydrophobic silica (R972, product of Nippon Aerosil Co., Ltd.).

Comparative Example 5

A developing roller of Comparative Example 5 was obtained in the same manner as in Example 3, except that the amount of the fluoroethylene vinyl ether copolymer was changed to 0.1189 parts, and the silica was changed to hydrophobic silica (R972, product of Nippon Aerosil Co., Ltd.).

Comparative Example 6

A developing roller of Comparative Example 6 was obtained in the same manner as in Example 3, except that the fluoroethylene vinyl ether copolymer was changed to 0.2484 parts of polyurethane polyol (A2789, product of Mitsui Chemicals, Inc.), and the silica was changed to hydrophobic silica (R972, product of Nippon Aerosil Co., Ltd.).

Comparative Example 7

A developing roller of Comparative Example 7 was obtained in the same manner as in Example 3, except that the fluoroethylene vinyl ether copolymer was changed to 0.5285 parts of an acrylic-modified fluororesin (DEFENSA TR101, product of DIC Corporation), and the silica was changed to hydrophobic silica (R972, product of Nippon Aerosil Co Ltd.).

The developing rollers of Examples and Comparative Examples were measured and evaluated for various properties as follows. Results are summarized and shown in Table 1.

<Production Method of Resin Dispersion>

A reaction container equipped with a condenser, a stirrer and a nitrogen-introducing pipe was charged with sodium dodecyl sulfate (0.7 parts) and ion-exchange water (498 parts), followed by heating to 80° C. under stirring for dissolution. Then, a solution of potassium persulfate (2.6 parts) in ion-exchange water (104 parts) was added to the resultant solution. Fifteen minutes thereafter, a monomer mixture of styrene monomer (200 parts) and n-octanethiol (4.2 parts) was added dropwise to the resultant mixed solution for 90 min. Subsequently, the resultant was maintained at 80° C. for 60 min to undergo a polymerization reaction, to thereby obtain a white resin dispersion having a volume average particle diameter of 135 nm.

Subsequently, 2 mL of the thus-obtained resin dispersion was added to a Petri dish, where a dispersion medium was evaporated to obtain a dry product. The resultant dry product was found to have the number average molecular weight of 8,300, the weight average molecular weight of 16,900, and Tg of 83° C.

<Synthesis of Polyester 1>

A reaction vessel equipped with a condenser, a stirrer and a nitrogen-introducing pipe was charged with bisphenol A ethylene oxide 2 mol adduct (229 parts), bisphenol A propylene oxide 3 mol adduct (529 parts), terephthalic acid (208 parts), adipic acid (46 parts) and dibutyl tin oxide (2 parts), followed by being allowed to react at 230° C. for 8 hours under a normal pressure. Next, the resultant reaction product was allowed to react for 5 hours under a reduced pressure of 10 mmHg to 15 mmHg. Then, trimellitic anhydride (44 parts) was added to the reaction vessel, followed by being allowed to react at 180° C. for 2 hours under a normal pressure, to thereby synthesize Polyester 1.

The resultant Polyester 1 was found to have the number average molecular weight of 2,500, the weight average molecular weight of 6,700, the glass transition temperature of 43° C. and the acid value of 25 mgKOH/g.

<Synthesis of Polyester 2>

A reaction container equipped with a condenser, a stirrer and a nitrogen-introducing pipe was charged with bisphenol A ethylene oxide 2 mol adduct (264 parts), bisphenol A propylene oxide 2 mol adduct (523 parts), terephthalic acid (123 parts), adipic acid (173 parts) and dibutyl tin oxide (1 part), followed by being allowed to react at 230° C. for 8 hours under a normal pressure. Next, the resultant reaction product was allowed to react for 8 hours under a reduced pressure of 10 mmHg to 15 mmHg. Then, trimellitic anhydride (26 parts) was added to the reaction container, followed by being allowed to react at 180° C. for 2 hours under a normal pressure, to thereby synthesize Polyester 2. The resultant Polyester 2 was found to have the number average molecular weight of 4,000, the weight average molecular weight of 47,000, the glass transition temperature of 65° C. and the acid value of 12 mgKOH/g.

<Synthesis of Isocyanate-Modified Polyester>

A reaction container equipped with a condenser, a stirrer and a nitrogen-introducing pipe was charged with bisphenol A ethylene oxide 2 mol adduct (682 parts), bisphenol A propylene oxide 2 mol adduct (81 parts), terephthalic acid (283 parts), trimellitic anhydride (22 parts) and dibutyl tin oxide (2 parts), followed by being allowed to react at 230° C. for 8 hours under a normal pressure. Next, the resultant reaction product was allowed to react for 5 hours under a reduced pressure of 10 mmHg to 15 mmHg, to thereby synthesize Intermediate polyester.

The resultant Intermediate polyester was found to have the number average molecular weight of 2,200, the weight average molecular weight of 9.700, the glass transition temperature of 54° C., the acid value of 0.5 mgKOH/g and the hydroxyl value of 52 mgKOH/g.

Next, a reaction container equipped with a condenser, a stirrer and a nitrogen-introducing pipe was charged with Intermediate polyester (410 parts), isophorone diisocyanate (89 parts) and ethyl acetate (500 parts), followed by being allowed to react at 100° C. for 5 hours, to thereby obtain Isocyanate-modified polyester.

<Preparation of Masterbatch>

Carbon black (REGAL 400R, product of Cabot Corporation) (40 parts), a binder resin (polyester resin, RS-801, product of Sanyo Chemical Industries, Ltd., acid value: 10 mgKOH/g, Mw: 20,000, Tg: 64° C.) (60 parts) and water (30 parts) were mixed together with HENSCHEL MIXER, to thereby obtain a mixture containing pigment aggregates impregnated with water. The resultant mixture was kneaded for 45 min with a two-roll mill of which roll had been adjusted to have a surface temperature of 130° C. The kneaded product was pulverized with a pulverizer so as to have a size of 1 mm, to thereby obtain Masterbatch.

<Preparation Step of Oil Phase>

A container to which a stirring rod and a thermometer had been set was charged with Polyester 1 (545 parts), [paraffin wax (melting point: 74° C.)] (181 parts) and ethyl acetate (1,450 parts). The resultant mixture was increased in temperature to 80° C. under stirring, maintained at 80° C. for 5 hours, and cooled to 30° C. for 1 hour.

Then, the container was charged with Masterbatch (500 parts) and ethyl acetate (100 parts), followed by mixing for 1 hour, to thereby obtain Raw material solution. The resultant Raw material solution (1,500 parts) was placed in the container, where the pigment and the wax were dispersed with a bead mill (ULTRA VISCOMILL, product of AIMEX CO., Ltd.) under the following conditions: liquid feed velocity: 1 kg/hr, disc circumferential velocity: 6 m/s, 0.5 mm-zircon a beads packed to 80% by volume, and 3 passes.

Next, a 66% solution of Polyester 2 in ethyl acetate (655 parts) was added thereto, and passed once with the bead mill under the above conditions, to thereby obtain Pigment/wax dispersion liquid. The resultant Pigment/wax dispersion liquid (976 parts) was mixed for 1 min at 5,000 rpm with TK HOMOMIXER (product of PRIMIX Corporation). Then, Isocyanate-modified polyester (88 parts) was added thereto. The resultant mixture was mixed for 1 min at 5,000 rpm with TK HOMOMIXER (product of PRIMIX Corporation), to thereby obtain Oil phase.

Through measurement, the solid content of Oil phase was found to be 52.0%, and the amount of ethyl acetate relative to the solid content was found to be 92%.

<Preparation of Aqueous Phase>

Ion-exchange water (970 parts), a 25% aqueous dispersion liquid of organic resin particles for stabilizing dispersion (a copolymer of sodium salt of styrene-methacrylic acid-butyl acrylate-methacrylic acid ethylene oxide adduct sulfuric acid ester) (40 parts), a 48.5% aqueous solution of sodium dodecyl diphenyl ether disulfonate (95 parts) and ethyl acetate (98 parts) were mixed together under stirring. The resultant mixture was found to have the pH of 6.2. Then, a 10% aqueous solution of sodium hydroxide was added dropwise thereto to adjust the pH to 9.5, to thereby obtain Aqueous phase.

<Production Step of Core Particles>

Aqueous phase (1,200 parts) was added to Oil phase. The resultant mixture was mixed for 2 min with TK HOMOMIXER at 8,000 rpm to 15,000 rpm, while adjusting a liquid temperature to 20° C. to 23° C. by cooling in a water bath in order to suppress an increase in temperature due to shear heat of the mixer. Thereafter, the resultant mixture was stirred for 10 min at 130 rpm to 350 rpm using a three-one motor equipped with an anchor wing, to thereby obtain Core particle slurry in which liquid droplets of Oil phase serving as core particles were dispersed in Aqueous phase.

<Formation of Shell Portion>

Resin dispersion (106 parts) was mixed with ion-exchange water (71 parts). The resultant mixture (solid content: 15%) was added so dropwise for 3 min to Core particle slurry while maintaining a liquid temperature at 22° C. This addition was performed while Core particle slurry was being stirred at 130 rpm to 350 rpm with a three-one motor equipped with an anchor wing. Thereafter, the resultant mixture was further stirred for 30 mm at 200 rpm to 450 rpm to obtain Composite particle slurry. Then, 1 mL of Composite particle slurry was diluted to 10 mL, followed by centrifugation. The resultant supernatant was transparent.

<Desolvation>

A container to which a stirrer and a thermometer had been set was charged with Composite particle slurry, which was desolvated with stirring at 30° C. for 8 hours to thereby obtain Dispersion slurry. A small amount of Dispersion slurry was placed on a glass slide, and observed through a cover glass under an optical microscope at a magnification of ×200. As a result, uniform colored particles were observed. Also, Dispersion slurry was 10-fold diluted, followed by centrifugation. The resultant supernatant was transparent.

<Washing Step>

Dispersion slurry (100 parts) was filtrated under a reduced pressure, and then the following washing procedures were performed to thereby obtain filtration cake.

- Ion-exchange water (100 parts) was added to filtration cake, followed by mixing with TK HOMOMIXER (at 12,000 rpm for 10 min) and filtrating.
- Ion-exchange water (900 parts) was added to the resultant filtration cake. The resultant mixture was mixed with TK HOMOMIXER (at 12,000 rpm for 30 min) under application of ultrasonic vibration, followed by filtrating under a reduced pressure. This procedure was repeated until the reslurry had an electrical conductivity of 10 μC/cm or lower.
- 10% hydrochloric acid was added to the resultant reslurry so as to have the pH of 4, followed by stirring for 30 min with a three-one motor and filtrating.
- Ion-exchange water (100 parts) was added to the resultant filtration cake, followed by mixing with TK HOMOMIXER (at 12,000 rpm for 10 min) and filtrating.
- This procedure was repeated until the reslurry had an electrical conductivity of 10 μC/cm or lower.

<Drying Step>

The filtration cake was dried with an air-circulation dryer at 45° C. for 48 hours, and then sieved with a mesh having an opening size of 75 μm to thereby obtain Toner base.

<External Addition Step>

Toner base (100 parts) was stirred using HENSCHEL MIXER with 88200 (hydrophobic silica, product of Nippon Aerosil Co., Ltd.) (1.5 parts), RY50 (hydrophobic silica, product of Nippon Aerosil Co., Ltd.) (3.0 parts), and SW360 (strontium titanate, product of Titan Kogyo, Ltd.) (0.6 parts), which were served as external additives. The resultant mixture was sieved to thereby obtain a toner for evaluation in which an external additive is attached onto a surface of each of toner base particles. A coverage rate of the toner base particle was 180%.

1. Peak Intensity Ratio (NCO/OH) Measured by Attenuated Total Reflection Method (ATR Method)

A universal ATR accessory was fixed onto FT-IR (Spectrum One Type B, product of Perkin Elmer Co., Ltd.). A sample, which had been exfoliated from a surface of a developing roller by applying a cutter toward a metal core thereof, was set on an ATR crystal so that a toner bearing layer was brought into contact with the ATR crystal. Then, a press lever was moved onto the crystal and was made to apply pressure to the sample, to thereby measure an IR spectrum. The press lever was adjusted so that the pressure value shown in a monitor as 10, and the measurement was performed 8 times. From the obtained IR spectrum, a peak intensity ratio (NCO/OH) of a single peak (1,680 $cm^{-1}$ to 1,690 $cm^{-1}$ thereabout) of a NCO group in isocyanurate to a single peak (1,710 $cm^{-1}$ to 1,730 $cm^{-1}$ thereabout) of an OH group was calculated.

Note that, a numerical value described in parentheses in the following table denotes a molar ratio of NCO to OH. That is, formulations described in the table are NCO-rich.

2. Filming

Under an environment of 27° C. and 80% RH, a developing roller was mounted to IPSIO C730 (product of Ricoh Company, Ltd.) and after printing on 20,000 sheets at 1% yield 1 P/J, a silica deposition amount was measured by Fourier transform infrared spectroscopy (FTIR) with FT-IR (NEXUS470, product of Thermo Fisher Scientific K.K.), followed by evaluating according to the following criteria.

[Evaluation Criteria]

A: less than 0.03

B: 0.03 or more but less than 0.10

C: 0.10 or more but less than 0.30

D: 0.30 or more

3. Charge Reduction

At 23° C. and 50% RH, a developing roller was mounted to IPSIO C730 (product of Ricoh Company, Ltd.) and then Q/M (charge amount per unit mass) at 1% yield 1 P/J was measured, to thereby determine a reduction rate of a Q/M after printing on 20,000 sheets relative to an initial Q/M before printing). The reduction rate was according to the following criteria. The Q/M was measured with a compact suction coulometer MODEL 212HS (product of TREK JAPAN).

[Evaluation Criteria]

A: less than 15%

B: 15% or more but less than 25%

C: 25% or more but less than 50%

D: 50% or more

4. Background smear

Under an environment of 27° C. and 80% RH, a developing roller was mounted to IPSIO C730 (product of Ricoh Company, Ltd.) and a toner deposition on a photoconductor during development of a blank sheet at 1% yield 1 P/J was measured by X-LITE (product of SAKATA INX ENG. CO., LTD), followed by evaluating according to the following criteria.

[Evaluation Criteria]

A: L* was 92.0 or more.

B: L* was 90.5 or more but less than 92.0.

C: L* was 89.5 or more but less than 90.5.

D: L* was less than 89.5.

5. Width of Concave Portion in Fine Convexoconcave

Using a laser microscope (product of KEYENCE CORPORATION) and a lens having a magnification of ×50, a surface of a toner bearing layer was photographed at a pitch of 0.1 μm. Based on the resultant convexoconcave profile, distances between a peak and an adjacent peak at 100 points were measured and averaged. The resultant average value was determined as a width of a concave portion in fine convexo-concave.

TABLE 1

| Example or Comparative Example | NCO/OH | Filming | Charge reduction | Background smear | Width of concave portion (μm) |
|---|---|---|---|---|---|
| Ex. 1 | 7.14 (90-fold) | A | A | A | 2.5 |
| Ex. 2 | 7.15 (90-fold) | B | B | B | 1.8 |
| Ex. 3 | 7.12 (90-fold) | A | B | B | 3.1 |
| Ex. 4 | 7.14 (90-fold) | A | B | C | 2.4 |
| Ex. 5 | 7.15 (90-fold) | A | B | C | 3.0 |
| Ex. 6 | 7.14 (90-fold) | A | B | B | 2.3 |
| Ex. 7 | 8.71 (100-fold) | A | A | A | 2.4 |
| Ex. 8 | 5.69 (80-fold) | A | A | A | 2.4 |
| Ex. 9 | 7.12 (90-fold) | A | B | C | 2.2 |
| Ex. 10 | 7.14 (90-fold) | A | A | A | 2.3 |
| Ex. 11 | 7.14 (90-fold) | A | A | A | 2.3 |
| Ex. 12 | 7.14 (90-fold) | A | A | A | 2.2 |
| Comp. Ex. 1 | 7.13 (90-fold) | A | D | D | 4.1 |
| Comp. Ex. 2 | 0 (90-fold) | B | D | D | 2.5 |
| Comp. Ex. 3 | 0 (90-fold) | B | D | D | 3.2 |
| Comp. Ex. 4 | 9.58 (105-fold) | D | C | C | 2.6 |
| Comp. Ex. 5 | 5.10 (75-fold) | D | C | C | 2.6 |
| Comp. Ex. 6 | 7.13 (90-fold) | D | D | D | 2.5 |
| Comp. Ex. 7 | 7.13 (90-fold) | C | D | D | 3.2 |

Embodiments of the present invention are as follows, for example.

<1> A developing roller, including:

a shaft containing a metal;

an elastic layer on a circumference of the shaft; and a surface layer on a circumferential surface of the elastic layer, wherein the surface layer contains: a polyurethane which is a reaction product between a fluoroethylene vinyl ether copolymer and an isocyanurate form of an isocyanate; and particles having an average primary particle diameter of 5 nm to 30 nm, and wherein the polyurethane has a peak intensity ratio of a NCO c group to a hydroxyl group of 5.6 to 8.8 in an infrared absorption spectrum obtained by an attenuated total reflection method.

<2> The developing roller according to <1>, wherein the isocyanate is hexamethylene diisocyanate.

<3> The developing roller according to <1> or <2>, wherein the particles are hydrophobized silica.

<4> The developing roller according to any one of <1> to <3>, wherein the particles have an average primary particle diameter of 10 nm to 20 nm.

<5> The developing roller according to any one of <1> to <4>, wherein widths of concave portions in fine convexoconcave in a surface of the surface layer are 2.0 μm to 3.0 μm on average.

<6> The developing roller according to any one of <1> to <5>, wherein the surface of the surface layer includes: a plurality of streaky groove portions each extending along a circumferential direction of the developing roller; and a plurality of protruded portions each extending along a direction of a rotational axis of the developing roller.

<7> The developing roller according to <6>, wherein an average of lengths of the groove portions in the circumferential direction is 20 μm to 50 μm, an average of depths of the groove portions is 2 μm to 5 μm, and an average of pitches of the groove portions is 10 μm to 50 μm.

<8> The developing roller according to <6> or <7>, wherein an average of lengths of the protruded portions in the direction of the rotational axis is 50 μm to 500 μm, an average of heights of the protruded portions is 2 μm to 5 μm, and an average of pitches of the protruded portions is 50 μm to 200 μm.

<9> A developing device, including:

a toner;

a toner-conveying unit configured to convey the toner; and a regulating unit configured to regulate a thickness of a layer of the toner supplied to a surface of the toner-conveying unit, wherein the developing device is a one-component developing device, wherein the toner-conveying unit includes the developing roller according to any one of <1> to <8>, and wherein an average circularity of the toner is 0.970 or more.

<10> A process cartridge, including:

the developing device according to <9>, wherein the process cartridge is mounted to a main body of an image forming apparatus in an attachable and detachable manner, <11> An image forming apparatus, including:

the developing device according to <9>.

This application claims priority to Japanese application No. 2013-094515, filed on Apr. 26, 2013 and Japanese application No. 2013-146011, filed on Jul. 12, 2013, and incorporated herein by reference.

What is claimed is:

1. A developing roller, comprising:

a shaft containing a metal;

an elastic layer on a circumference of the shaft; and a surface layer on a circumferential surface of the elastic layer, wherein the surface layer comprises: a polyurethane which is a reaction product between a fluoro ethylene vinyl ether copolymer and an isocyanurate form of an isocyanate; and particles having an average primary particle diameter of 5 nm to 30 nm, and wherein the polyurethane has a peak intensity ratio of a NCO group to a hydroxyl group of 5.6 to 8.8 in an infrared absorption spectrum obtained by an attenuated total reflection method.

2. The developing roller according to claim 1, wherein the isocyanate is hexamethylene diisocyanate.

3. The developing roller according to claim 1, wherein the particles are hydrophobized silica.

4. The developing roller according to claim 1, wherein the particles have an average primary particle diameter of 10 nm to 20 nm.

5. The developing roller according to claim 1, wherein widths of concave portions in fine convexoconcave in a surface of the surface layer are 2.0 μm to 3.0 μm on average.

6. The developing roller according to claim 1, wherein the surface of the surface layer comprises: a plurality of streaky groove portions each extending along a circumferential direction of the developing roller; and a plurality of protruded portions each extending along a direction of a rotational axis of the developing roller.

7. The developing roller according to claim 6, wherein an average of lengths of the groove portions in the circumferential direction is 20 μm to 50 μm, an average of depths of the groove portions is 2 μm to 5 μm, and an average of pitches of the groove portions is 10 μm to 50 μm.

8. The developing roller according to claim 6, wherein an average of lengths of the protruded portions in the direction of the rotational axis is 50 μm to 500 μm, an average of heights of the protruded portions is 2 μm to 5 μm, and an average of pitches of the protruded portions is 50 μm to 200 μm.

9. A developing device, comprising:

a toner;

a toner-conveying unit configured to convey the toner; and a regulating unit configured to regulate a thickness of a layer of the toner supplied to a surface of the toner-conveying unit, wherein the developing device is a one-component developing device, wherein an average circularity of the toner is 0.970 or more, and wherein the toner-conveying unit comprises a developing roller which comprises:

a shaft containing a metal;

an elastic layer on a circumference of the shaft; and a surface layer on a circumferential surface of the elastic layer, wherein the surface layer comprises: a polyurethane which is a reaction product between a fluoroethylene vinyl ether copolymer and an isocyanurate form of an isocyanate; and particles having an average primary particle diameter of 5 nm to 30 nm, and wherein the polyurethane has a peak intensity ratio of a NCO group to a hydroxyl group of 5.6 to 8.8 in an infrared absorption spectrum obtained by an attenuated total reflection method.

10. A process cartridge, comprising:

a developing device, wherein the process cartridge is mounted to a main body of an image forming apparatus in an attachable and detachable manner, and wherein the developing device comprises:

a toner;

a toner-conveying unit configured to convey the toner; and a regulating unit configured to regulate a thickness of a layer of the toner supplied to a surface of the toner-conveying unit, wherein the developing device is a one-component developing device, wherein an average circularity of the toner is 0.970 or more, and wherein the toner-conveying unit comprises a developing roller which comprises:

a shaft containing a metal;

an elastic layer on a circumference of the shaft; and a surface layer on a circumferential surface of the elastic layer, wherein the surface layer comprises; a polyurethane which is a reaction product between a fluoroethylene vinyl ether copolymer and an isocyanurate form of an isocyanate; and particles having an average primary particle diameter of 5 nm to 30 nm, and wherein the polyurethane has a peak intensity ratio of a NCO group to a hydroxyl group of 5.6 to 8.8 in an infrared absorption spectrum obtained by an attenuated total reflection method.

* * * * *